US006023803A

United States Patent [19]

Barman

[11] Patent Number: 6,023,803

[45] Date of Patent: Feb. 15, 2000

[54] MATTRESS WITH HIGH ILD FIRM TOPPER

[75] Inventor: Bruce G. Barman, Broadview Hts., Ohio

[73] Assignee: Ohio Mattress Company Licensing and Components Group, Trinity, N.C.

[21] Appl. No.: 08/966,117

[22] Filed: Nov. 7, 1997

[51] Int. Cl.[7] ..... A47C 27/045

[52] U.S. Cl. ..... 5/716; 5/721

[58] Field of Search ..... 5/716, 717, 718, 5/721, 737, 740, 901, 903

[56] References Cited

U.S. PATENT DOCUMENTS

| | | | |
|---|---|---|---|
| 2,192,601 | 3/1940 | Mattison . | |
| 3,047,888 | 8/1962 | Shecter et al. . | |
| 3,210,781 | 10/1965 | Pollock . | |
| 3,833,259 | 9/1974 | Pershing . | |
| 3,885,258 | 5/1975 | Regan . | |
| 4,463,466 | 8/1984 | May et al. | 5/721 |
| 4,686,725 | 8/1987 | Mitchell | 5/901 X |
| 4,777,855 | 10/1988 | Cohen . | |
| 4,999,868 | 3/1991 | Kraft . | |
| 5,022,111 | 6/1991 | Fenner, Sr. . | |
| 5,136,740 | 8/1992 | Kraft | 5/903 X |
| 5,138,730 | 8/1992 | Masuda . | |
| 5,163,194 | 11/1992 | Dixon . | |
| 5,317,768 | 6/1994 | Klancnik | 5/737 X |
| 5,469,590 | 11/1995 | Simon | 5/721 |
| 5,787,532 | 8/1998 | Langer et al. | 5/717 |

*Primary Examiner*—Michael F. Trettel
*Attorney, Agent, or Firm*—Calfee, Halter & Griswold LLP

[57] ABSTRACT

A mattress employs a high density, high ILD convoluted polyurethane foam topper as a major transition layer over the supporting surfaces of an innerspring assembly in order to provide a smooth transition from the support characteristics of the padding and upholstery layers to the innerspring assembly. A high density, high ILD foam material of substantial thickness is positioned between a padding or insulating layer over the innerspring assembly and overlying upholstery, with convolutions in the high density transition layer oriented to extend away from the innerspring assembly. The high density transition layer dominates or masks the support characteristics of the innerspring assembly so that the perception of stiffness or board-like feel of an innerspring is greatly reduced upon initial loading of the mattress.

11 Claims, 2 Drawing Sheets

MATTRESS WITH HIGH ILD FIRM TOPPER

FIELD OF THE INVENTION

The present invention pertains generally to mattresses and, more particularly, to mattresses which have innerspring assemblies covered by multiple layers of padding and material.

BACKGROUND OF THE INVENTION

For many years mattresses have been constructed with innerspring assemblies with multiple wire-form springs, covered by several layers of insulating, padding and upholstery material. For example, a fiber mat layer is secured directly over the tops of the springs, one or more intermediate foam layers above the fiber layer, a backing or ticking layer over the foam layer and connected to the innerspring assembly, and one or more upholstery layers which may also include bunting or other padding.

One performance deficiency associated with mattresses of this type of construction is a very noticeable and abrupt transition from the relatively soft and easily compressible upholstery and padding layers to the relatively stiff innerspring assembly. These is a result of the large difference in the nature of the combined materials, going from layers of fabric, foam and fibers, to wire-form steel. Even with additional layers of foam or fiber padding the harsh transition may not be avoided, owing to the relatively low density and easy compressibility of the layers. The use of low density, low ILD foams as padding layers gives a mattress a high degree of initial softness, but does not avoid the board-like firmness when the foam layers are quickly and fully compressed upon the innerspring assembly, causing the mattress to "bottom out" under high loadings.

SUMMARY OF THE INVENTION

The present invention overcomes these and other disadvantages of the prior art by providing a mattress with a relatively high density foam top layer as the primary cushioning layer in a mattress having an innerspring assembly. In accordance with one aspect of the invention, there is provided a mattress having an innerspring assembly with a plurality of wire form spring elements arranged in an array with axis of the spring elements generally parallel and terminal ends of the spring elements located in a common plane which defines a support surface of the innerspring assembly. At least one padding layer is positioned over a supporting surface of the innerspring assembly, and a transition layer of polyurethane foam, having a density in the approximate range of 1.6 to 2.5 pounds per cubic foot and an ILD rating in the approximate range of 60 to 90, positioned over the padding layer, at least one foam layer positioned over the transition layer, the foam layer having a density and ILD rating less than the transition layer, and an upholstery layer positioned over the foam layer and secured about the innerspring assembly.

In accordance with one aspect of the invention, a mattress includes an innerspring assembly having a plurality of spring elements arranged in an array with axes of the spring elements generally parallel and ends of the spring elements in a common plane which defines a support surface of the innerspring assembly, at least one padding layer positioned over a support surface of the innerspring assembly, a transition layer positioned over the padding layer, the transition layer consisting of polyurethane foam having a density in an approximate range of 1.6 pounds per cubic foot, and an ILD rating in an approximate range of 60 to 90, and at least one foam layer positioned over the transition layer opposite to the padding layer, the foam layer having a density and ILD rating less than the transition layer, and an upholstery layer positioned over the foam layer and secured over the transition layer, the padding layer and the innerspring assembly.

In accordance with another aspect of the invention, a mattress has a wire form innerspring assembly including an array of spring elements which extend between opposed support surface of the innerspring assembly, at least one padding layer overlying a support surface of the innerspring assembly, at least one foam layer overlying the padding layer, a transition layer overlying foam layer, the transition layer having a density in an approximate range of 1.6 to 2.5 pounds per cubic foot and an ILD rating in an approximate range of 70 to 90, a backing layer overlying the transition layer and attached to the innerspring assembly, and an upholstery layer overlying the backing layer.

And in accordance with another aspect of the invention, a mattress has an innerspring assembly which provides opposed support surfaces having a flexible support characteristic determined by a number and arrangement of spring elements in the innerspring assembly, layers of material overlying the opposed support surfaces of the innerspring assembly, the layers including at least one padding layer adjacent to the supporting surface of the innerspring assembly, a transition layer of polyurethane foam having a density in an approximate range of 1.6 to 2.5 pounds per cubic foot and a support characteristic which dominates the support characteristic of the innerspring assembly upon application of a load to the mattress, such that the support characteristic of the innerspring assembly cannot be perceived by human touch upon initial compression of the mattress, and an upholstery layer over the transition layer.

These and other aspects of the invention are described herein in particularized detail with reference to the accompanying Figures, wherein like reference numerals refer to like parts.

Figure 1:
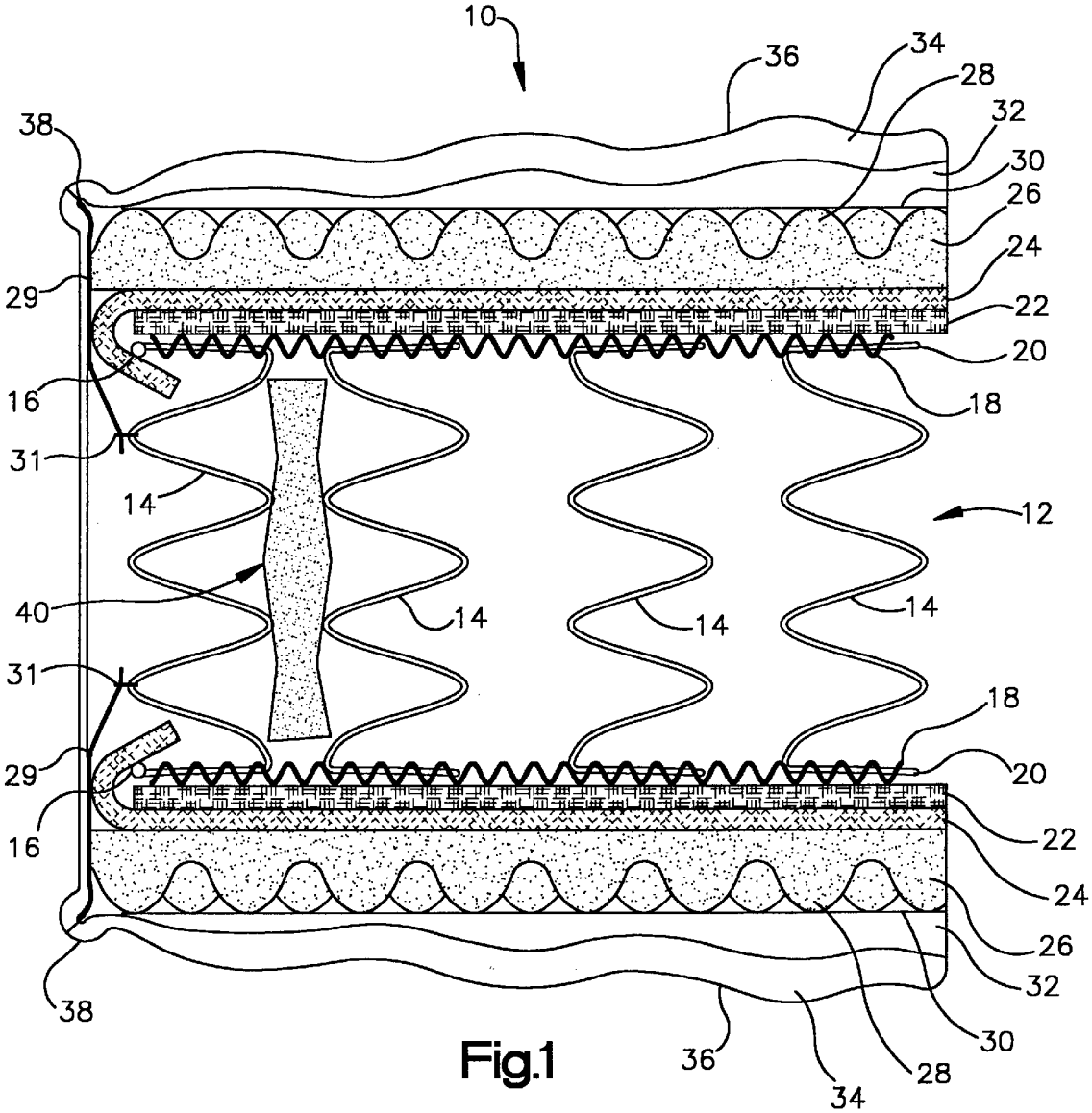
FIG. 1 is a cross-sectional view of a mattress constructed in accordance with the present invention.

Detailed Description of Preferred and Alternate Embodiments

With reference to the Figures, there is shown in cross-section a mattress 10 with an innerspring assembly, indicated generally at 12, which includes a plurality of spring elements 14 held in an array by interconnection with cross-wires (not shown) and a borderwire 16 by lacing wires 18. Terminal ends 20 of the innersprings are held in a common plane which defines the opposed top and bottom supporting surfaces of the innerspring assembly over which the material layers are attached. The innerspring assembly 12 is assembled prior to attachment of the insulating, padding and upholstery layers as described below.

Although depicted as generally symmetrical or identical sequences of layers of material over the innerspring assembly, it is understood that other arrangements and sequences of materials, including non-identical or non-symmetrical layers of material relative to the opposed sides of the mattress could be employed within the scope of the invention. In the depicted examples, an SP2, SP3 or SP4 fiber layer 22 is first laid over the supporting surface of the innerspring assembly, followed by a layer 24 of polyurethane foam of comparable thickness. A high ILD transition layer 26 of polyurethane foam includes convolutions 28 which are oriented away from the innerspring assembly. The transition layer 26 is preferably a polyurethane foam with a density in the approximate range of 1.6 to 2.5 lbs./cubic foot and an ILD (Indentation Load Deflection) rating in the approximate range of 60–90, according to ASTM D 3575, for example, 60–90 lbs. of force required to achieve 25% compression of a 4 inch cube of the foam. The convolutions 28 may be generally dome shaped and have the approximate dimensions of 1" diameter base and ½" height, though other configurations and dimensions may be suitably employed. Preferably, the maximum thickness of the transition layer 26 is greater than the thickness of any other foam layer in the mattress. The transition layer also preferably occupies more than 25% of the total average thickness of the material layers which overlie the opposed support surfaces of the innerspring assembly. The transition layer 26 functions to ameliorate the board-like feel of the innerspring support surface by providing a significant or large mass of compressible material over the innerspring assembly, at the specified density and ILD values.

Figure 2:
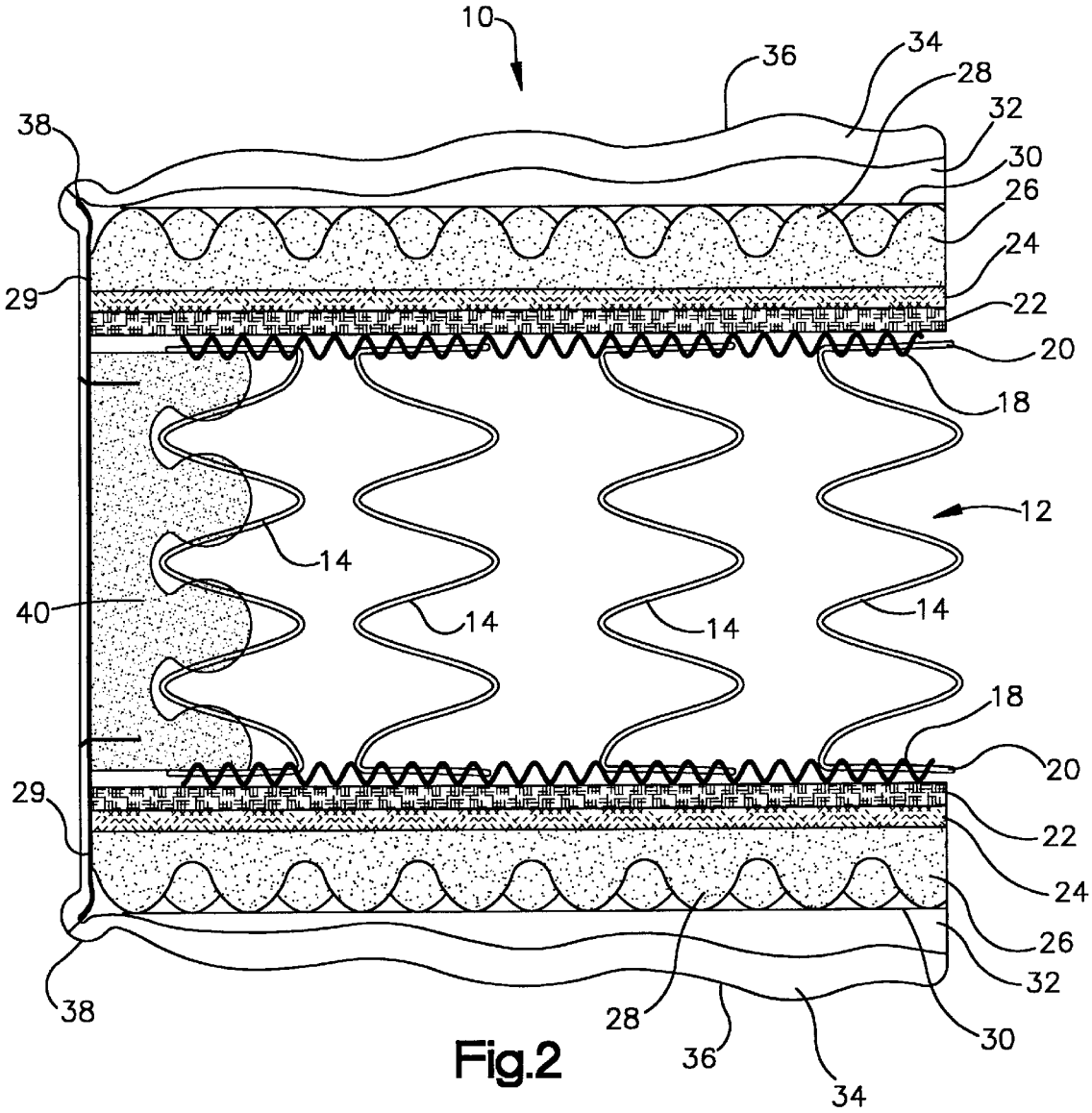
FIG. 2 is a cross-sectional view of a mattress constructed in accordance with the present invention.

An MT backing layer 30, such as for example a nonwoven fabric, is applied over the convolutions 28 of transition layer 26, and secured to a flange 29 which is tied to the innerspring assembly spring elements at the perimeter by hog rings 31 or other means. Additional relatively thin and less dense foam layers 32 and 34 overlie transition layer 26, and covered directly by upholstery ticking 36 which is sewn to a binding tape 38 at the edges of the mattress. An internal support structure 40, such as a rigid foam piece, may be inserted into the innerspring assembly, between the spring elements as in FIG. 1, or engaged with the peripheral spring elements and forming an internal wall structure as in FIG. 2, prior to attachment of the layers of material. In the embodiment of FIG. 2, the flange 29 is stapled or otherwise secured directly to the internal support structure 40.

By this arrangement, the transition layer 26, being of substantially greater density than the other compressible layers of material in the mattress, and also being closer in support density to the innerspring assembly, provides a smooth transition in support characteristics and feel from the upholstery and padding layers to the innerspring assembly. In other words, the high ILD foam of the transition layer is compressed at a slower rate so that body weight is more gradually transferred through the material layers to the innerspring assembly. This avoids a more sudden or abrupt transfer of weight to the innerspring assembly which is perceived as a board-like, relatively rigid support surface. The upward orientation of the convolutions 28 further contributes to a gradual increase in support resistance, from the upper upholstery and padding layers, to the high ILD transition layer 26, to the innerspring assembly 12. Thus, when combined with an innerspring assembly which is relatively rigid, the high ILD transition layer 26 masks or disguises the stiffness of such an innerspring upon initial loading, so that the mattress initially feels soft, but still provides firm overall support.

Although described with reference to certain best modes and preferred embodiments, the invention can be alternatively employed in the context of other combinations of layers of materials over various types of innerspring assemblies or other flexible support surfaces. In general, the use of a high density polyurethane foam layer which is positioned at or near the top of a plurality of material layers underneath an exterior upholstery is within the general scope of the invention, as defined by the claims and equivalents thereof.

What is claimed is:

1. A mattress comprising:

an innerspring assembly having a plurality of spring elements arranged in an array with axes of the spring elements generally parallel and ends of the spring elements in a common plane which defines a support surface of the innerspring assembly, at least one padding or insulating layer positioned over a support surface of the innerspring assembly, a transition layer positioned over the padding layer, the transition layer consisting of polyurethane foam having a density in an approximate range of 1.6 pounds per cubic foot to 2.5 pounds per cubic foot, and an ILD rating in an approximate range of 60 to 90, and at least one foam layer positioned over the transition layer opposite to the padding layer, the foam layer having a density and ILD rating less than the transition layer, and an upholstery layer positioned over the foam layer and secured over the transition layer, the padding layer and the innerspring assembly.

2. The mattress of claim 1 wherein the transition layer further comprises convolutions which protrude from a surface of the transition layer, and wherein the convolutions are oriented to extend away from the padding layer and the innerspring assembly.

3. The mattress of claim 1 further comprising a foam layer between the padding layer and the transition layer, the foam layer having a density and ILD rating less than the transition layer.

4. A mattress having a wire form innerspring assembly including an array of spring elements which extend between opposed support surfaces of the innerspring assembly, at least one padding or insulating layer overlying a support surface of the innerspring assembly, at least one foam layer overlying the padding layer, a transition layer overlying the foam layer, the transition layer having a density in an approximate range of 1.6 to 2.5 pounds per cubic foot and an ILD rating in an approximate range of 70 to 90, a backing layer overlying the transition layer and attached to the innerspring assembly, and an upholstery layer overlying the backing layer.

5. The mattress of claim 4 wherein the foam layer has a density and ILD rating less than the density and ILD rating of the transition layer.

6. The mattress of claim 4 wherein the transition layer further comprises convolutions oriented to extend away from the innerspring assembly.

7. The mattress of claim 4 wherein the transition layer has a thickness dimension greater than a thickness dimension of any other layer of foam in the mattress.

8. The mattress of claim 4 further comprising a support member within the innerspring assembly.

9. The mattress of claim 4 wherein the transition layer comprises greater than 25% of a total average thickness of material overlying a support surface of the innerspring assembly.

10. The mattress of claim 6 wherein a height dimension of the convolutions of the transition layer is approximately 50% or greater than a total thickness dimension of the transition layer.

11. The mattress of claim 4 with an identical sequence of layers overlying each of the opposed support surfaces of the innerspring assembly.

* * * * *